United States Patent [19]

Love

[11] Patent Number: 5,048,828

[45] **Date of Patent: * Sep. 17, 1991**

[54] BATTING PRACTICE DEVICE

[76] Inventor: Carl D. Love, 4348 Baton Rouge Dr., Hermitage, Tenn. 37076

[ * ] Notice: The portion of the term of this patent subsequent to Feb. 6, 2007 has been disclaimed.

[21] Appl. No.: 549,378

[22] Filed: Jul. 6, 1990

[51] Int. Cl.[5] ..... A63B 69/40

[52] U.S. Cl. ..... 273/26 E

[58] Field of Search ..... 273/26 E, 58 C, 29 R, 273/4 B, 29 A, 200 R, 411, 197 A, 200 B, 413, 414, 184 B, 185 C, 330, 208, 240, 319, 321, 332, 335, 414, 413; 446/30, 31

[56] References Cited

U.S. PATENT DOCUMENTS

| | | | |
|---|---|---|---|
| 2,842,366 | 7/1958 | Fant | 273/26 E |
| 3,397,885 | 9/1968 | Nash, Jr. | 273/26 E |
| 3,994,494 | 11/1976 | Kelley | 273/26 E |
| 4,322,075 | 3/1982 | Hynes | 273/26 |
| 4,415,155 | 11/1983 | Goudreau et al. | 273/26 E |
| 4,664,375 | 5/1987 | Tetreault | 273/26 E |
| 4,898,385 | 2/1990 | Love | 273/26 E |

*Primary Examiner*—Theatrice Brown

*Attorney, Agent, or Firm*—Mark J. Patterson; Edward D. Lanquist, Jr.

[57] ABSTRACT

A batting practice device has a first tether means attached to the top of a vertical pole at one end and supporting a ball and at the other end. A second tether means is attached to the pole and is attached to the first tether means above the ball.

5 Claims, 1 Drawing Sheet

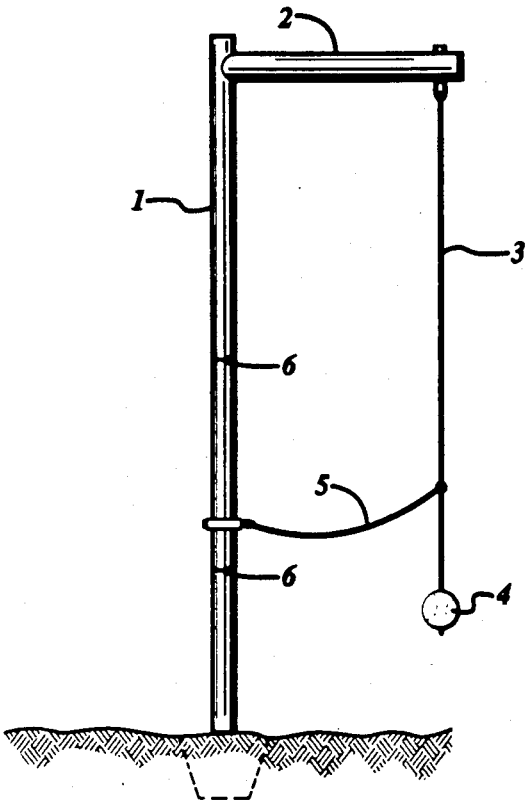
FIG 1
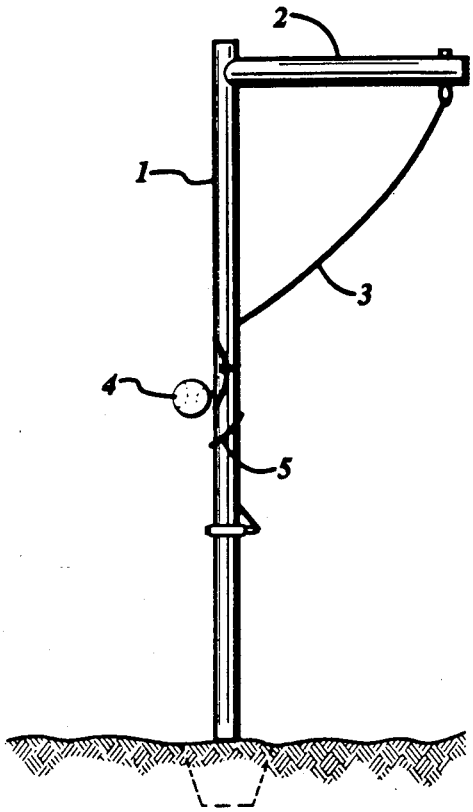
FIG 2
FIG 3
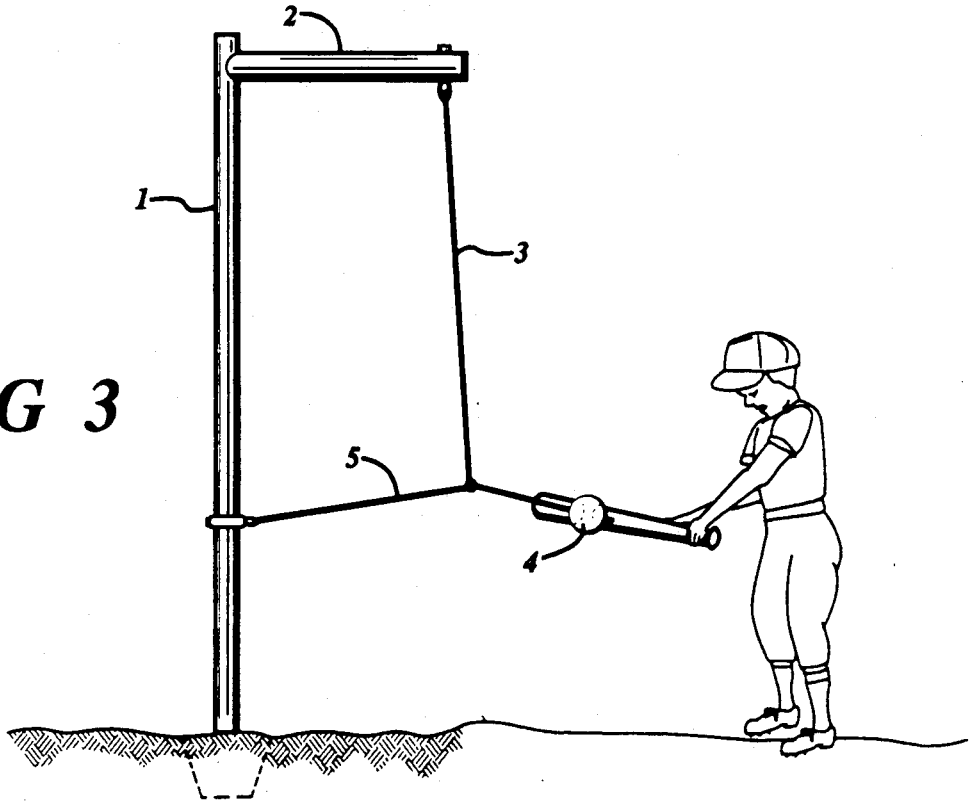

BATTING PRACTICE DEVICE

BACKGROUND OF THE INVENTION

The present invention relates to devices used to practice batting a baseball or softball.

Because it is often inconvenient or inefficient to use live or machine pitching for baseball batting practice, a number of prior art devices have been developed to allow a young baseball player to hit a baseball without the need for other players to pitch or retrieve the ball. Typical prior art structures are found in U.S. Pat. Nos. 4,322,075; 4,415,155; 3,830,494; 4,010,950; 4,050,694; 3,006,647; 3,366,383; 3,454,275; 2,976,040; 2,058,277; 4,508,340; 3,994,494; and 4,502,684.

The prior art devices, however, have been deficient in one or more significant areas. Some are too complex and expensive for purchase and use by young ball players. Or, they lack features to prevent dangerous return movement of the ball after it is hit or to return the ball to a hitting position with a simulated pitching motion. For example, U.S. Pat. No. 4,322,075 is, in many respects, quite similar to the present invention, in that it has a first and second tether. Yet, it has some of the drawbacks just referred to. Although the second tether of the '075 device restricts dangerous return ball action, it also requires the batter to continue to hit a relatively stationary ball, as if on a batting tee. Also, the height of the second tether on the pole must be adjusted for batters of varying size. In addition, because the second tether is fixed at its ball-end, a mis-hit above the ball could cause injury to the batter when the bat motion is stopped abruptly by the restraining first and second tethers.

U.S. Pat. No. 4,898,385, issued to Applicant on Feb. 6, 1990, overcame some of the limitations of the prior art devices. U.S Pat. No. 4,898,385 did provide a batting practice device which is tethered to maximize safety, which automatically self-adjusts to the strength and size of the batter, and which simulates a pitched ball motion. However, U.S. Pat. No, 4,898,385, as well as U.S. Pat. Nos. 4,322,075 and 3,994,494, all require a horizontal arm extending from the pole that supports the batting practice device. This horizontal arm required in the prior art makes the prior art more expensive.

What is needed, then is a batting practice device which is tethered to maximize safety, which automatically self-adjusts to the strength and size of the batter, which simulates a pitched ball motion, and which does not require the expense and construction of a horizontal arm.

SUMMARY OF THE INVENTION

The present invention is an improvement over conventional batting practice devices. The present invention comprises a vertical pole; a first tether attached to the top of the vertical pole at one end and supporting a ball at the other end, and a second tether attached either fixedly or slidably to the first tether and to the vertical pole. The length of the first and second tethers, the height of the vertical pole, and the locations of the attachment points are selected within a range such that the hit ball will wrap around the vertical pole and then safely return to a hitting position and with a motion which simulates a pitched ball. The attachment of the second tether to the first tether allows the height and motion of the ball to adjust automatically due to the centrifugal force placed on the ball when hit by batters of various sizes and strengths when first tether is slidably attached to second tether. The height of the vertical pole is adjustable.

Accordingly, one object of the present invention is to provide a batting practice device which maximizes safety.

Another object of the present invention is to provide a batting practice device which can be set to automatically self-adjust to the strength and size of the batter.

Still another object of the present invention is to provide a batting practice device which simulates a pitched ball motion.

A further object of the present invention is to provide a simpler and less expensive batting practice device which does not require a horizontal arm attached to the vertical pole.

BRIEF DESCRIPTION OF THE DRAWINGS

FIG. 1 is a side view of a ground-mounted batting practice device before use.

FIG. 2 is a side view of the device after the ball has been hit and before the return action begins.

FIG. 3 is a side view of the device showing the ball being returned to the hitting position with a simulated pitched motion.

DESCRIPTION OF THE PREFERRED EMBODIMENT

As best seen in FIG. 1, the present invention comprises a vertical pole 1, of conventional wood Or metal construction, which can be ground-mounted as shown or attached to a weighted base for portability or at indoor application. The length of pole 1 above the ground or practice level should be approximately 78 inches to allow the practice device to be used by batters of varying sizes and strengths. However, the length of pole 1 can be adjusted by expansion of telescoping joints 6. Therefore, vertical pole 1 can be adjusted upwardly for a taller batter and adjusted downwardly for a shorter batter.

Attached to the top of pole 1 is first tether 3, which, in the preferred embodiment, uses an eye bolt or other conventional fastener 2. First tether 3 and second tether 5 are made of a non-elastic rope material and, again, for optimum universality of usage, first tether 3 should be approximately 55 inches long. Permanently affixed to the lower end of first tether 3 is ball 4. First tether 3 can be attached either directly to the top of pole 1, or to an arm horizontally extending from the top of pole 1, as shown.

Second tether 5, also non-elastic, is secured to the inside surface of pole 1 at a point approximately 32 inches above the practice surface, and is attached at its other end to first tether 3. The attachment can be achieved by a knot, such as a slip knot, or other means of attachment of second tether 5 to first tether 3 to allow either the fixed attachment or the sliding vertical movement of the end of second tether 5 along first tether 3 under tension. As seen in FIG. 1, sufficient frictional contact between the attachment means and tether 3 is maintained to fix the attachment point of tether 5 when the device is at rest. So attached, the position of tether 5 will adjust over an approximate 12 inch range to automatically adjust any slack of tethers 3 and 5 which may be created when ball 4 is hit when tethers 3 and 5 are slidably connected. In addition, the position of the ball at the end of tether 3 will adjust over an approximate 18 inch range due to the centrifugal force placed on the ball when hit and will automatically compensate for the swing level and power of the batter. Experimentation has shown that the optimum length of tether 5 is approximately 20 inches, while the initial attachment point of tether 5 to tether 3 should be approximately 16 inches above the ball. This provides tether 3 with the slack which is necessary to allow proper adjustment of tension in tethers 3 and 5 when the ball is hit.

Horizontal tether 5 can also be configured to be non-sliding. It is secured to the inside surface of pole 1 at a point approximately 32 inches above the batting practice surface and is attached at its other end to vertical tether 3. The knot or other means of attachment of tether 5 to tether 3 would not allow for any sliding vertical movement of the end of tether 5 along tether 3 under tension. Experimentation has shown that with this configuration, the optimum length of tether 5 would also be approximately 20 inches, while the attachment point of tether 5 to tether 3 should be approximately 26 inches above the ball. So attached, the position of the ball at the end of tether 3 will adjust over the same approximate 18 inch range due to the centrifugal force placed on the ball when hit and will automatically compensate for the swing level and power of the batter.

With the horizontal tether 3 fixedly or slidably attached as described and shown, rather than directly to ball 4 as in the prior art, and by selecting the dimensions or ratio of dimensions of the other structures of the device to approximate those given above, the function of the device is optimized. As the batter approaches the device, its position is as shown in FIG. 1. The batter then will ordinarily place ball 4 in motion manually by pulling the ball away from pole 1 and then throwing the ball around pole 1, causing tether 3 to move away from the batter and wrapping most of tethers 3 and 5 around pole 1, as seen in FIG. 2. The momentum of ball 4 and tension applied by tethers 3 and 5 cause ball 4 to unwrap and return to a hitting position with a swinging motion that simulates a pitched ball, as seen in FIG. 3. When ball 4 is hit, and tether 5 is placed under tension, tether 5 will cause tether 3 and tether 5 to Wrap around vertical pole. The position of the ball at the end of tether 3 will adjust over an approximate 18 inch range due to the centrifugal force placed on the ball when hit and will automatically compensate for the swing level and power of the batter. Similarly, and unlike the prior art horizontal tether devices, if the batter misses the ball and hits, instead, tether 3, the motion of the bat will not be abruptly halted because of the pendulum swing effect produced by the connection of tether 5 to tether 3.

Although in the preferred embodiment, a baseball is used as ball 4, a tennis ball, softball, or any other ball can be used instead without altering the operation of the present invention. Also, tether 3 can be made entirely or partially of elastic material. The use of an elastic tether causes ball 4 to have an increased velocity when returning to be hit.

Thus, although there have been described particular embodiments of the present invention of a new and useful batting practice device, it is not intended that such reference be construed as limitation upon the scope of this invention except as set forth in the following claims. Further, although there have been described certain dimensions used in the preferred embodiment, it is not intended that such dimensions be construed as limitations upon the scope of this invention, except as set forth in the following claims.

What is claimed is:

1. A batting practice device for use with a ball comprising:

a. a pole extending vertically from and secured to a practice surface;

b. a first tether means having its upper end attached proximate to the top of said pole;

c. said ball secured to the lower end of said first tether means;

d. a second tether means with one end connected to said pole, and the other end connected to said first tether means at a point intermediate its upper and lower ends.

2. The device of claim 1 wherein said pole is vertically adjustable.

3. The device of claim 1 where the length of said second tether means is such that when said ball is at rest, and when the connecting point of said second tether means to said first tether means is approximately 16 to 28 inches from the end of said first tether means, there is sufficient slack in said second tether means, when said first tether means is slidably attached to said second tether means, to allow for a vertical slidable movement of approximately 12 inches of travel of said slidable connection along said first tether means when the ball is struck and in motion.

4. The device of claim 1 where the dimensions or corresponding ratios of dimensions are approximately as follows:

a. the length of said pole is 78 inches;

b. the length of said first tether means is substantially 55 inches;

c. the length of said second tether means is substantially 20 inches; and d. the distance from said practice surface or stand to the attachment point of said second tether means to said pole is substantially 32 inches.

5. A batting practice device for use with a ball comprising:

a. a pole extending vertically from and secured to a stand;

b. a first tether means having its upper end attached proximate to the top of said pole;

c. said ball secured to the lower end of said first tether means; and d. a second tether means with one end connected to said pole, and the other end connected to said first tether means at a point intermediate its upper and lower ends.

* * * * *